US010170271B2

(12) United States Patent
Chaki et al.

(10) Patent No.: US 10,170,271 B2
(45) Date of Patent: Jan. 1, 2019

(54) X-RAY GENERATOR AND X-RAY ANALYZER

(71) Applicant: RIGAKU CORPORATION, Tokyo (JP)

(72) Inventors: Tomohiro Chaki, Tokyo (JP); Manabu Noguchi, Tokyo (JP)

(73) Assignee: RIGAKU CORPORATION, Tokyo (JP)

( * ) Notice: Subject to any disclaimer, the term of this patent is extended or adjusted under 35 U.S.C. 154(b) by 177 days.

(21) Appl. No.: 15/502,959

(22) PCT Filed: Aug. 18, 2015

(86) PCT No.: PCT/JP2015/073165
§ 371 (c)(1),
(2) Date: Feb. 9, 2017

(87) PCT Pub. No.: WO2016/039091
PCT Pub. Date: Mar. 17, 2016

(65) Prior Publication Data

US 2017/0236678 A1 Aug. 17, 2017

(30) Foreign Application Priority Data

Sep. 12, 2014 (JP) ..... 2014-186170

(51) Int. Cl.
*H01J 35/10* (2006.01)
*H01J 35/28* (2006.01)
*H01J 35/16* (2006.01)

(52) U.S. Cl.
CPC ..... *H01J 35/28* (2013.01); *H01J 35/10* (2013.01); *H01J 35/16* (2013.01); *H01J 2235/081* (2013.01); *H01J 2235/086* (2013.01)

(58) Field of Classification Search
None
See application file for complete search history.

(56) References Cited

U.S. PATENT DOCUMENTS

2005/0190887 A1* 9/2005 Kim ..... H01J 35/14 378/125
2015/0170869 A1* 6/2015 Heid ..... H01J 35/08 378/125

(Continued)

FOREIGN PATENT DOCUMENTS

JP 44-23539 Y1 10/1969
JP 3-043251 U 4/1991

(Continued)

OTHER PUBLICATIONS

International Search Report (PCT/ISA/210) dated Nov. 17, 2015, by the Japan Patent Office as the International Searching Authority for International Application No. PCT/JP2015/073165.

(Continued)

*Primary Examiner* — Hoon K Song
(74) *Attorney, Agent, or Firm* — Buchanan Ingersoll & Rooney PC

(57) ABSTRACT

Provided is an X-ray generator having: an anode that faces a cathode which generates electrons; a plurality of X-ray generation zones; a casing housing the cathode and the anode; an anode support body for supporting the anode; an air cylinder for producing advancing and retreating movement of the anode support body with respect to the casing; and a stopper device that halts the movement of the anode support body when the anode support body moves in a direction approaching the casing. The stopper device has a rotating plate equipped with a section that enters and exits from between the anode support body and the casing due to rotation, a motor for driving the same, and a plurality of stop members provided in a peripheral section of the rotating plate and having mutually different heights.

12 Claims, 10 Drawing Sheets

(56) References Cited

U.S. PATENT DOCUMENTS

| | | | | |
|---|---|---|---|---|
| 2015/0279608 | A1* | 10/2015 | Miyaoka | H01J 37/16<br>378/138 |
| 2016/0329185 | A1* | 11/2016 | Miyaoka | H01J 37/16 |

FOREIGN PATENT DOCUMENTS

| | | | |
|---|---|---|---|
| JP | 2007-525807 | A | 9/2007 |
| JP | 2008-269933 | A | 11/2008 |

OTHER PUBLICATIONS

Written Opinion (PCT/ISA/237) dated Nov. 17, 2015, by the Japan Patent Office as the International Searching Authority for International Application No. PCT/JP2015/073165.

* cited by examiner

X-RAY GENERATOR AND X-RAY ANALYZER

TECHNICAL FIELD

The present invention relates to an X-ray generator having as anode that is equipped with a plurality of X-ray generation zones. The invention also relates to an X-ray analyzer that employs the X-ray generator.

BACKGROUND ART

In X-ray analyzers, i.e., X-ray diffractometers, fluorescent X-ray devices, small-angle X-ray scattering devices, and the like, X-rays generated from an X-ray generator irradiate a specimen targeted for analysis. In a typical X-ray generator, electrons generated from a cathode are made to collide against the surface of an anode, thereby generating X-rays from the surface of the anode. The region where the electrons collide, i.e., the region where X-rays are generated, is typically called the X-ray focal point.

The wavelength of the X-rays generated from the anode is determined by the material of the region that corresponds to the X-ray focal point in the anode. Known materials for anodes include Cu (copper), Mo (molybdenum), Cr (chromium), Co (cobalt), and the like. The material of the anode, is selected, as appropriate, according to the type of analysis that is to he carried out. For example, in a case in which structural analysis of a protein is to be carried out by an X-ray diffractometer, a plurality of materials selected from the above plurality of mate would be employed.

Conventionally, according to Patent Literature 1, there is disclosed in FIG. 1 of the Literature a configuration for using negative pressure produced by suction of sir to move the anode housing that supports the anode, and by this movement selectively arranging an X-ray generation -zone of one kind from among two kinds on the anode, to a position facing the cathode.

In this conventional device, a gap is formed by means of two wall surfaces, namely, a wall surface of a casing that houses the anode and a wall surface of a protruding member that extends from the casing, and within this gap is arranged a flange that extends from the anode housing. The components are then arranged so that the cathode and one of the X-ray generation zones are facing when the flange of the anode housing has abutted the wall surfaces, and the cathode and another one of the X-ray generation zones are facing when the flange of the anode housing has abutted the wall surface of the protruding member.

That is, in the X-ray generator of Patent Literature 1, two X-ray generation zones are respectively arranged at positions facing the cathode, while using the wall surface of the casing and the wall surface of protruding member as stoppers. However, with this method, there is a problem in that for an anode equipped with three or more X-ray generation zones, any one of the X-ray generation zones thereof cannot be stationed at a position facing the cathode.

According to FIG. 8 of Patent Literature 1, there is disclosed a method whereby a stopper device for an anode equipped with three or more X-ray generation zones is configured by placing the distal end of a check bolt in abutment against a flange of the housing to station any one of the X-ray generation zones at a position facing the cathode. With this method, the amount of threading of the check bolt is adjusted to change the position of the distal end, so that the position at which the anode stops can be changed.

CITATION LIST

Patent Literature

Patent Literature 1: Japanese Unexamined Patent Application Publication No. 2008-269933

SUMMARY OF INVENTION

Technical Problem

However in the position adjustment method for the anode X-ray generation zones disclosed in Patent Literature 1, the check screw is threaded in manually, and therefore there was a problem in that it is not possible to automate the task of selecting one of a plurality of X-ray generation zones and arranging the zone at a position facing the cathode, and the process cannot be carried out with high accuracy.

The present invention was contrived in view of the aforementioned problems of the prior art devices, and has as an object to provide an X-ray generator and an X-ray analyzer with which one of three or more X-ray generation zones provided on an anode can be stationed at a prescribed position facing the cathode, and by which the operation can be carried out automatically and with high accuracy.

Solution to Problem

The X-ray generator according to the present invention is an X-ray generator comprising: a cathode for generating electrons; an anode provided facing the cathode, and equipped with a plurality of X-ray generation zones which are lined up adjacently to one another; a casing fox housing the cathode and the anode in the interior thereof, and integrated with the cathode; an anode support body for supporting the anode; driving means for driving the anode support body in such a way that the anode support body and the casing undergo relative advancing and retreating movement; and stopper means for stopping motion of the anode support body when the anode support body and the casing move in a direction of approaching one another. The stopper means comprising: a mobile platform equipped with a section that enters and exits from between the anode support body and the casing; a mobile platform drive means for driving the mobile platform; and a plurality of stop members of mutually different heights provided in the entering and exiting section of the mobile platform.

According to this X-ray generator, the plurality of stop members of different heights are moved by a mobile platform drive means such as a motor, whereby the positions of a plurality of X-ray generation zones of the anode are changed, and therefore setting of the position of the X-ray generation zones can be accomplished automatically rather than manually.

Further, conventionally, the distal end surface of a check bolt was employed as a stopper in order to adjust the positions of three or more X-ray generation zones, and the position of the distal end of the check bolt was changed by varying the amount of threading of the check bolt, With this method, the position of the X-ray generation zones could not be adjusted finely or with high accuracy.

By contrast, according to the present embodiment, any one of the plurality of stop members of different heights is selectively interposed between the anode support body and the casing, whereby the anode which is supported by the anode support body and the cathode which is supported by the casing are adjusted in their relative positions, and therefore the relative positions of the cathode and the X-ray generation zones on the anode can be positioned finely and with high accuracy.

the X-ray generator according to the present invention, the mobile platform may be provided in such a way as to be able to move in a direction closer towards or away from the casing, in a state in which at least one of the plurality of stop members is placed between the anode support body and the casing. With this configuration, unwanted load bearing on the mobile platform which supports the stop members can be prevented.

In the aforementioned configuration, the stop members may be urged by elastic members (e.g., compression springs). With this configuration, the stop members which are moveably provided on the mobile platform can be kept always arranged at a given position in a natural state by means of the elastic force of the elastic members.

In the aforementioned configuration, the stop members may have lengths that are greater than the thickness of the mobile platform, the stop members may be provided to pass through the mobile platform, and the stop members may be configured such that one end thereof is capable of abutting against either the casing or the anode support body, and the other end of the stop member is capable of abutting against the other of the casing or the anode support body.

In the X-ray generator of the present invention, the mobile platform may be a rotating plate, the plurality of entering and exiting sections may peripheral sections of the rotating plate, and the plurality of stop members may be provided at different positions of the peripheral sections of the rotating plate. With this configuration, the stopper means of the present invention can be this configuration, the stopper means of the present invention can be realized in a simple fashion.

In the aforementioned X-ray generator having a rotating plate as the mobile platform, the mobile platform moving means can be a motor, the motor may be one having a main body section, and an output shaft that extends to the outside from the interior of the main body section, the rotating plate may be attached to the output shaft, and the main body section of the motor may be secured to the anode support body or to the casing.

In the X-ray generator of the present invention, a plurality of the stopper means may be provided on the anode support body or on the casing. In so doing, positioning of the anode can be carried out with high accuracy.

The X-ray generator of the present invention employing the plurality of stopper means may have a seal member for airtightly partitioning a space between the anode support body and the casing. In this X-ray generator, the plurality of stopper means may be arranged point-symmetrically with respect to the center axis of the seal member within a plane orthogonal to the center axis, or line-symmetrically with respect to a line that passes through the center axis. In so doing, the accuracy of positioning of the anode can be further enhanced.

In the X-ray generator of the present invention which employs a plurality of the stopper means, the stopper means may be arranged at mutually equidistant spacing with respect to the center axis of the seal member, and at mutually equiangular spacing about the center axis. In so doing, the accuracy of positioning of the anode can be further enhanced.

In the X-ray generator of the present invention, the space between the anode support body and the casing may be airtightly partitioned by a bellows. That is, the seal member may be formed by the bellows. The stopper means may be provided outside the bellows. With this configuration, the X-ray generator can be easily manufactured.

In the X-ray generator according to the present invention, the anode support body may have an anode housing that supports the anode and extends to the outside of the anode, and a support plate that is secured to the anode housing and extends in a direction traversing the direction of extension of the anode housing. The drive means and the stopper means may be arranged on the support plate. With this configuration, a structure for supporting the anode can be formed in a simple manner, and the X-ray generator, including the drive means and the stopper means, can be kept compact.

Next, the X-ray analyzer of the present invention is an X-ray analyzer comprising an X-ray generator of the configuration disclosed above, and an X-ray optical system employing X-rays generated by the X-ray generator. The X-ray optical system may be, for example, an optical system comprising a combination of a divergence slit, scattering slit, receiving slit, an X-ray detector 13, and the like. Elements besides these X-ray optical elements may be included in the X-ray optical system as well.

Advantageous Effects of Invention

According to the X-ray generator of the present invention, the plurality of stop members of different heights are moved by the mobile platform moving means, which is a motor or the like, whereby one of the plurality of stop members can be selected, for use. As a result, positioning of the X-ray generation zones can foe carried out automatically, not manually.

Moreover, conventionally, the distal end surface of a check bolt was employed as a stopper in order to adjust the positions of three or more X-ray generation zones, and the position of the distal end surface of the check bolt was changed by varying the amount of threading of the check bolt. With this method, the position of the X-ray generation zones could not be adjusted automatically/with high accuracy.

By contrast, according to the X-ray generator of the present invention, any one of the plurality of stop members of different heights is interposed between the anode support body and the casing, whereby a plurality of X-ray generation zones located at a multitude of different positions on the anode can be positions finely and with high accuracy, with respect to the cathode.

DESCRIPTION OF EMBODIMENTS

Figure 1:
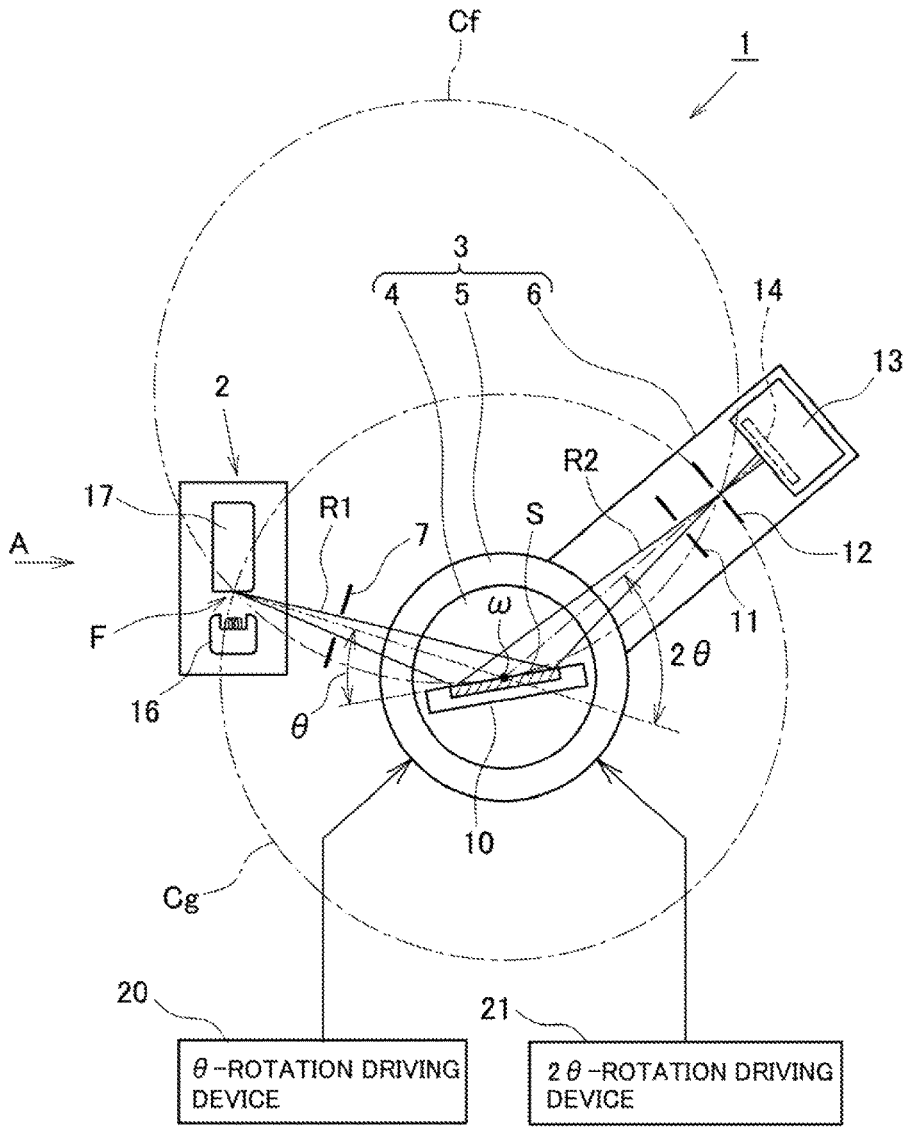
FIG. 1 is a front view showing an embodiment of the X-ray analyzer according to the present invention.

The X-ray generator and the X-ray analyzer according to the present invention shall be described below on the basis of embodiments. The present invention is not limited to these embodiments, as shall he apparent. In the drawings appended to the present description, constituent elements are in some instances depicted at a scale different from the actual one, in order to facilitate understanding of characteristic features.

(X-Ray Diffractometer)

FIG. 1 is a front view showing an X-ray diffractometer 1 as an embodiment of the X-ray analyzer according to the present invention. The in-plane direction of the page in the drawing is the vertical direction, and the direction passing through the page is the horizontal direction. This X-ray diffractometer 1 has an X-ray generator 2 and a goniometer 3. The goniometer 3 has a θ-rotation platform 4, a 2θ-rotation platform 5, and a detector arm 6 that extends from the 2θ-rotation platform 5.

The θ-rotation platform 4 is rotatable about its own center axis ω. The center axis ω extends in a direction passing through the page on FIG. 1. The 2θ-rotation platform 5 is also rotatable about this same center axis ω. A divergence slit 7 is provided between the X-ray generator 2 and the goniometer 3. This divergence slit 7 regulates divergence of X-rays exiting from, the X-ray generator 2, and causes the X-rays to irradiate a specimen S.

A specimen holder 10 is detachably installed on the θ-rotation platform 4, and the specimen S being measured is accommodated within the specimen holder 10. For example, the specimen S may be packed into a recessed portion or through-opening provided to the specimen holder 10. On the detector arm 6 are provided a scattering slit 11, a receiving slit 12, and a two-dimensional X-ray detector 13 by way of an X-ray detection means. The scattering slit 11 prevents scattered rays which are unwanted for the purposes of analysis from, entering the X-ray detector 13. The receiving slit 12 passes secondary X-rays, e.g., diffracted X-rays, exiting from the specimen S, while blocking other unwanted X-rays.

The two-dimensional X-ray detector 13 has a two-dimensional sensor 14. The two-dimensional sensor 14 is an X-ray sensor that has a position resolution function in a two-dimensional area (i.e., within a plane). A position resolution function is a function for detecting X-ray intensity on a per-position basis. This two-dimensional sensor 14 is an X-ray detector having, for example, a plurality of photon-counting type pixels arranged two-dimensionally (i.e., in planar fashion). The sensor has the function of outputting electrical signals of magnitude that corresponds to the intensity of X-rays received by the individual photon-counting type pixels. Therefore, the two-dimensional sensor 14 is designed to simultaneously receive in planar fashion X-rays from a plurality of pixels, and independently output electrical signals from each of the pixels.

The two-dimensional sensor 14 could also be configured from a two-dimensional charge coupled device (CCD) sensor. A two-dimensional CCD sensor is a two-dimensional sensor in which individual pixels for receiving X-rays are formed by CCDs.

Depending on the type of measurement being performed, a one-dimensional X-ray detector could be used in place of the two-dimensional X-ray detector 13. A one-dimensional X-ray detector is an X-ray detector that has a position resolution function within a one-dimensional area (i.e., within a linear area). The one-dimensional X-ray detector may be, for example, a position sensitive proportional counter (PSPC), an X-ray detector that employs a one-dimensional CCD sensor an X-ray detector in which a plurality of photon-counting type pixels are arranged one-dimensionally, or the like.

Depending on the type of measurement being performed, a 0(zero) dimensional X-ray detector may be used instead of a two-dimensional X-ray detector. A 0 (aero) dimensional X-ray detector is an X-ray detector that lacks a position resolution function relating to X-ray intensity. This 0 (zero) dimensional X-ray detector may be, for example, an X-ray detector that employs a proportional counter (PC), an X-ray detector that employs a scintillation counter (SC), or the like.

The X-ray generator 2 is arranged secured at a given position. This X-ray generator 2 has a cathode 16 that emits thermal electrons through electrical conduction, and a rotating anode 17 arranged facing the cathode 16. Electrons emitted from the cathode 16 collide at high speed with the outer peripheral surface of the rotating anode 17. The area in which the electrons collide is an X-ray focal point F, and X-rays are generated at this X-ray focal point. The planar shape of the X-ray focal point is, for example, 0.2 mm×2 mm. The X-rays R1 generated from the rotating anode 17, the divergence angle thereof having been regulated by the divergence slit 7, impinge on the specimen S.

The θ-rotation platform 4 rotates about the ω-axis while driven by a θ-rotation driving device 20. This rotation is intermittent rotation at prescribed step angles, or continuous rotation at a prescribed angular velocity. This rotation of the θ-rotation platform 4 is rotation that takes place in order to change the angle of incidence θ of X-rays on the specimen S, and is typically called θ-rotation.

The 2θ-rotation platform 5 rotates about the ω-axis while driven by a 2θ-rotation driving device 21. This rotation is typically called 2θ-rotation. This 2θ-rotation is rotation that takes place in such a way that when secondary X-rays (e.g. diffracted X-rays) R2 are generated from the specimen S at times when X-rays, are incident on the specimen S at an incident angle θ, the secondary X-rays can be received by the X-ray detector 13.

The θ-rotation driving device 20 and the 2θ-rotation driving device 21 may be configured with any rotation driving devices. Such a rotation device may be configured, for example, from a rotation power source and a power transmission device. The rotation power source may be configured, for example, with a controllable-rotation speed motor, e.g., a servo motor, or a stepping motor. The power transmission device may be configured, for example, with a worm secured to the output shaft of the rotation power source, and a worm wheel that meshes with the worm, and is secured to the center shaft of the θ-rotation platform 4 or to the center shaft of the 2θ-rotation platform 5.

When the θ-rotation platform. 4 and the specimen S installed thereon undergo θ-rotation, and the 2θ-rotation platform 5 and the X-ray detector 13 supported thereon undergo 2θ-rotation, the X-ray focal point F is arranged fixed on a goniometer circle Cg that is centered on the axis ω, while the X-ray collection point of the receiving silt 12 moves over the goniometer circle Cg. During θ-rotation of the specimen S and 2θ-rotation of the X-ray detector 13, the X-ray focal point F, the ω-axis, and the X-ray collection point of the receiving slit 12 are present on a focusing circle Cf. The goniometer circle Cg is a constant-radius hypothetical circle, and the focusing circle Cf is a hypothetical circle that changes in radius in association with changes of the θ angle and the 2θ angle.

In the present embodiment, the X-ray optical system is configured with the divergence slit 7, the specimen S, the scattering slit 11, the receiving slit 12, and the X-ray detector 13. If needed, the X-ray optical system may include other X-ray optical elements. Such X-ray optical elements could be, for example, a collimator, a solar slit, a monochromator, or the like.

The operation of the X-ray diffractometer 1 configured as described above will be described below.

First, if needed, the various X-ray optical elements present on the X-ray path leading from the X-ray focal point F to the X-ray detector 13 are correctly aligned in position on the X-ray optical axis. That is, optical axis adjustment is performed. Next, the X-ray incident angle θ with respect to the specimen S and the diffraction angle 2θ of the X-ray detector 13 are set so the desired initial positions (zero positions).

Next, by passing current through the cathode 16 to heat it, thermal, electrons are generated from the: cathode 16. These electrons, while being restricted in the direction of advance by an electric field that is usually applied by a Wehnelt (not illustrated), collide at high speed against the surface of the rotating anode 17 and form the X-ray focal point F. X-rays of wavelength that is dependent on the material of the rotating anode 17 are then emitted from the X-ray focal point F. The current that flows to the rotating anode 17 from the cathode 16 due to electrical conduction to the cathode 16 is typically called tube current. In order to accelerate the electrons that are emitted from the cathode 16 and collide with the rotating anode 17, a prescribed large voltage is applied across the cathode 16 and the rotating anode 17. This voltage is typically called tube voltage. In the present embodiment, the tube voltage and the tube current are respectively set to 30-60 kV and 10-120 mA. The rotating anode material will be discussed below.

The X-rays R1 that are emitted and diverge from the X-ray generator 2 include continuous X-rays that include X-rays of various wavelengths, and characteristic X-rays of specific wavelength. In cases in which it is desired to select desired characteristic X-rays from among these X-rays, an incidence-side monochromator (an "incident monochromator") is provided on the X-ray optical path leading from the X-ray generator 2 to the specimen S. The X-rays R1, divergence of which is regulated by the divergence slit 7, irradiate the specimen S. During intervals in which the specimen is undergoing θ-rotation .and the X-ray detector 13 is undergoing 2θ-rotation, when the X-rays R1 incident on the specimen S meet a prescribed rotation condition, with respect to the crystal, lattice planes inside the specimen, specifically, an angular state that satisfies the Bragg's diffraction angle, secondary X-rays, e.g., diffracted rays R2, are generated at a diffraction angle of 2θ from the specimen S. These diffracted rays R2 pass through the scattering slit 11 and the receiving slit 12 to be scattering slit 11 and the receiving slit 12 to be received by the X-ray detector 13. The X-ray detector 13 outputs a signal that is dependent on the count of X-rays received at individual pixels of the X-ray detector 13, and X-ray intensity is calculated on the basis of this output signal.

The aforedescribed X-ray intensity calculation process is carried out on each angle among the incident X-ray angles θ and the diffraction angles 2θ, as a result of which there is derived an X-ray intensity I (2θ) at each angular position of the diffraction angle 2θ. By plotting the X-ray intensity I (2θ) on plane coordinates where the diffraction angle 2θ is the horizontal axis and the X-ray intensity I is the vertical axis, an X-ray diffraction diagram of known type is derived. By then observing the generated, intensity (I) and the angle (2θ) at which the X-ray intensity peak waveform appearing on the X-ray diffraction diagram is generated, the internal structure of the specimen S can be analyzed.

(X-ray Generator)

The X-ray generator 2 will be described in detail below.

Figure 2:
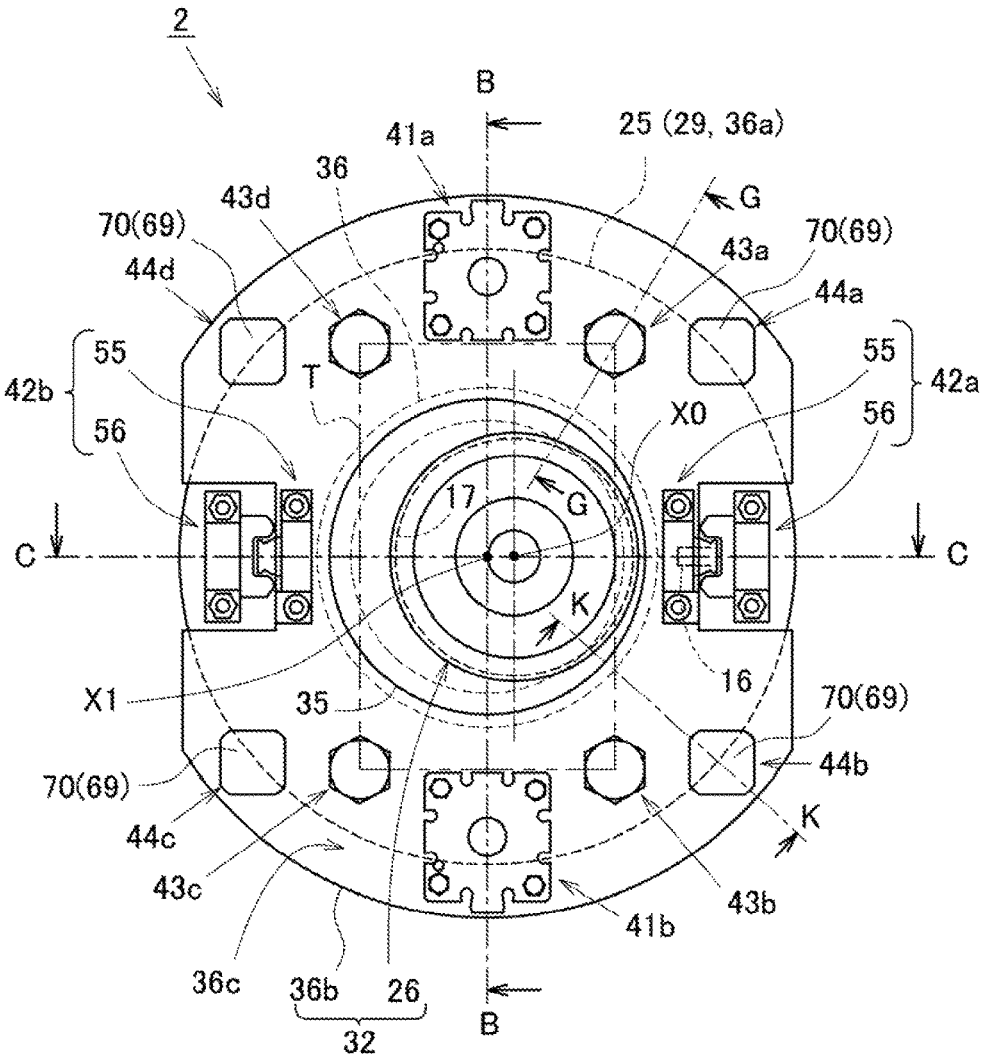
FIG. 2 is a front view showing an embodiment of the X-ray generator according to the present invention, viewed along arrow A in FIG. 1.
Figure 3:
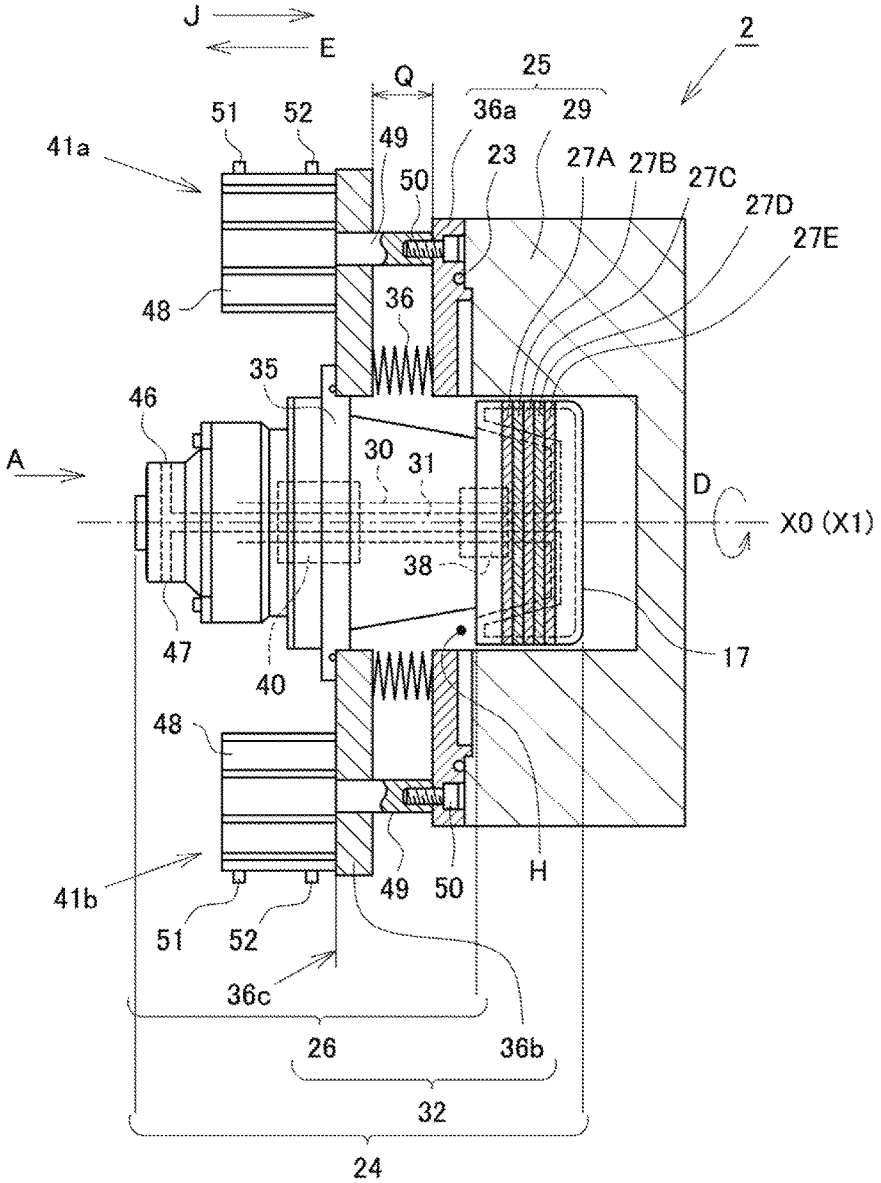
FIG. 3 is a cross sectional view showing the longitudinal cross sectional structure of the X-ray generator, taken along line B-B in FIG. 2.
Figure 4:
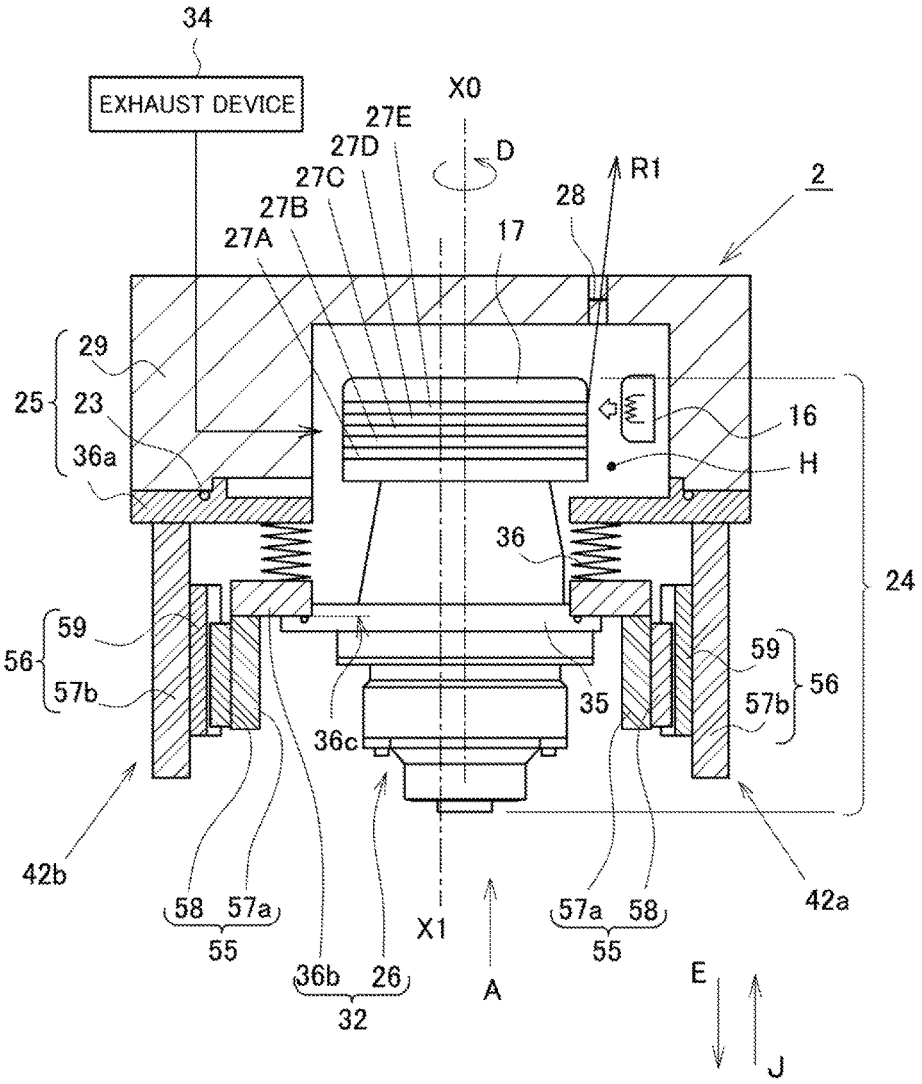
FIG. 4 is a cross sectional view showing the planar cross sectional structure of the X-ray generator, taken along line C-C in FIG. 2.

FIG. 2 shows the X-ray generator 2 viewed along arrow A in FIG. 1. FIG. 3 shows the longitudinal cross sectional structure of the X-ray generator 2, taken along line B-B in FIG. 2. FIG. 4 shows the planar cross sectional structure of the X-ray generator, taken along line C-C in FIG. 2. In FIG. 2 and FIG. 4, the X-ray generator 2 has the cathode 16 mentioned previously, the rotating anode 17 mentioned previously, an anode unit 24 that includes the rotating anode 17, and a bellows 36, as a seal material.

In the present embodiment, a welded bellows is employed as the bellows 36. The welded bellows has an accordion shape in which the outer peripheries and inner peripheries of a plurality of thin ring-shaped metal plates are joined together by welding. The bellows 36 is round in shape when viewed in the direction of arrow A, and cylindrical in shape overall. On the outer peripheral surface of the rotating anode 17 are provided a plurality (in the present embodiment, five) X-ray generation zones 21A, 27B, 27C, 27D, 27E, which are lined up adjacently to one another. The center axis X1 of the cylindrical shape of the bellows 36 extends in the direction in which the X-ray generation zones 27A to 27E are lined up (the vertical direction in FIG. 4).

One end of the bellows 36 (e.g., the end at the top side in FIG. 4) is anchored to a first flange 36*a*, by welding for example. The other end of the bellows 36 (the end at the bottom in FIG. 4) is anchored to a second flange 36*b*, by welding for example. As shown in FIG. 2, the planar shape of the first flange 36*a* is round.

For the planar shape and thickness of the first flange 36*a* and the second flange 36*b*, there can be adopted any shape besides the illustrated shapes, as needed. In some instances, the bellows 36 can be formed by a molded bellows instead of a welded bellows, or by a bellows of some other configuration. Molded bellows are bellows that have been formed by a molding process, instead of welding.

In FIG. 3 and FIG. 4, the first flange 36*a* of the bellows 36 is anchored by a bolt or other fastening means to a base 29 which is a metal member. An O-ring (i.e., an elastic ring) 23 for maintaining airtightness is interposed between the base 29 and the first flange 36*a*. A casing 25 is formed by the base 29 and the first flange 36*a*. The casing 25 has an internal space H for accommodating the anode 17 and the cathode 16. The base 29 (and hence the casing 25) and the cathode 16 are integrated.

An X-ray window 28 for extraction of the X-rays R1 generated by the rotating anode 17 is provided in a section of the base 29 of the casing 25. The X-ray window 28 is formed from a material through which X-rays can pass, for example, beryllium (Be).

The rotating anode unit 24 has an anode housing 26 that supports the rotating anode 17 and extends to the outside of the rotating anode 17. The anode housing 26 rotatably supports the rotating anode 17 about the axis X0 as shown by arrow D. The base 29 and the anode housing 26 are formed, for example, from copper or copper alloy. The anode housing 26 is formed to cylindrical shape as viewed from the direction of arrow A. The base 29 is formed to cylindrical shape as viewed from the direction of arrow A. The base 29 may be a cornered tube shape as well.

The rotating anode 17 is formed by disposing in a row arrangement a plurality of types (in the present embodiment, five types) of X-ray generation cones 27A, 27B, 27C, 27D, 27E on the outer peripheral surface of a base member formed from a material having high thermal conductivity (e.g., copper (Cu) or a copper alloy). The rotating anode 17 has a cup shape whose top is a closed plane as shown in FIG. 4. The X-ray generation zones 27A, 27B, 27C, 27D, 27E are lined up in the direction of extension of the center axis X0 of the rotating anode 17 (i.e., the axial direction of the rotating anode unit 24) and provided in ring shape (i.e. annular shape) in a band shape. The X-ray generation zones 27A, 27B, 27C, 27D, 27E are formed from mutually different materials, each being one material selected, e.g., from among Cu, Mo (molybdenum), Cr (chromium), Co (cobalt), or other metals.

The materials Mo, Cr, and Co are formed on a Cu base member, for example, by ion plating, plating, shrink fitting, or other appropriate film, forming method. The widths of the X-ray generation zones 27A, 27B, 27C, 27D, 27E in the axial direction are set to mutually equal lengths. Specifically, where the dimensions of the X-ray focal spot F are 0.2 mm×2 mm, the widths of the X-ray generation zones 27A, 27B, 27C, 27D, 27E in the axial direction are set to about 3 mm.

The anode housing 26 is formed to generally cylindrical shape centered on the axis X0. As shown in FIG. 3, in the interior of the anode housing 26 are provided a rotating shaft 30 which is integrated with the rotating anode 17, a motor 40 serving as the rotation driving device for driving rotation of the rotating shaft 30, a magnetic seal device 38 provided around the rotating shaft 30, and a water passage 31 for water used to cool the rotating anode 17. The rotating anode 17 rotates upon being driven by the motor 40. The rotation speed of the rotating anode 17 is 6,000 rpm, for example.

The magnetic seal device 38 is a shaft seal device for maintaining a pressure differential between the internal space H of the casing 25, which is in a high vacuum state, and the internal space of the anode housing 26, which communicates with atmospheric pressure. The magnetic seal device 38 has a magnetic fluid deposited on the outer peripheral surface of the rotating shaft 30 by magnetic force. Due to this magnetic fluid, a high vacuum is maintained to one side of the magnetic seal device 38, and atmospheric pressure to the other side. Because the magnetic fluid does not exert significant torque on the rotating shaft 30, the magnetic seal device 38 does not hamper rotation of the rotating shaft 30.

The water passage 31 connects to a water supply port 46 and a water discharge port 47 which are provided at the back end of the anode housing 26 (the left end in FIG. 3). Cooling water introduced into the anode housing 26 from the water supply port 46 is fed to the interior of the rotating anode 17 through the outbound section of the water passage 31, and cools the rotating anode 17 from the inside, and thereafter passes through the return section of the water passage 31 and is discharged to the outside from the water discharge port 47.

The internal structure of the rotating anode unit 24 is generally as described above. More specifically, the internal structure of the rotating anode unit disclosed, for example, in Japanese Unexamined Patent Application Publication 2008-269933 can be adopted.

In FIG. 3 and FIG. 4, the second flange 36*b* of the bellows 36 is secured to a flange 35 which is provided to the anode housing 26. The bellows 36 keeps the internal space K of the casing 25 in an airtight state with respect to atmospheric pressure. As shown in FIG. 4, this internal space H connects to an exhaust device 34. The exhaust, device 34 evacuates air from within this internal space H and maintains a high vacuum (hereinafter simply termed a "vacuum state") in the internal space H.

The exhaust device 34 can be configured, for example, as a combination of a rotary pump and a turbo molecular pump. The rotary pump is a pump that can reduce the pressure in the internal space H to a low vacuum. The turbo molecular pump is a pump that can further evacuate to a high vacuum state the atmosphere that has been reduced in pressure by the rotary pump. Through the action of this turbo molecular pump, the surrounding area of the rotating anode 17 and the cathode 16 can be placed under a high vacuums of $10^{-3}$ Pa or lower. Provided that the interior of the casing 25 can be placed in a high vacuum state, a combination of a high vacuum pump other than a turbo molecular pump and an auxiliary pump other than a rotary pump can be adopted.

In the present embodiment, the casing 25 is secured at an appropriate location of the X-ray diffractometer 1 of FIG. 1. In FIG. 4, the bellows 36 is a member which is extendable along its own center axis X1. In the present embodiment, the center rotational axis X0 of the rotating anode 17 diverges from the center axis X1 of the bellows 36. Naturally, the center rotational axis X0 of the anode housing 26 may be aligned with the center axis X1 of the bellows 36.

By disposing the bellows 36 between the casing 25 and the anode housing 26 in FIG. 4, even if the second flange 36*b* undergoes advancing or retracting motion with respect to the casing 25, the internal space H surrounding the anode 17 can be maintained in an airtight state by the extending and contracting action of the bellows 36. In the present embodiment, the anode housing 26 and the second flange 36*b* constitute an anode support body 32 for supporting the anode 17.

In FIG. 2, the surface 36*c* of the second flange 36*b* on the side away from the anode 17 (the front side in FIG. 2) is provided with a plurality (in the present embodiment, two) of air cylinders 41*a*, 41*b* as driving means, a plurality (in the present embodiment, two) of linear guides 42*a*, 42*b* as guiding means, a plurality (in the present embodiment, four) of assist units 43*a*, 43*b*, 43*c* 43*d* as elastic force imparting means, and a plurality (in the present embodiment, four) of stopper devices 44*a*, 44*b*, 44*c*, 44*d* as stopper means. In this manner, the second flange 36*b* of the bellows 36 functions as a support plate for supporting these devices, i.e., the air cylinders 41, 41*b*, the linear guides 42*a*, 42*b*, the assist units 43*a*, 43*b*, 43*c*, 43*d*, and the stopper devices 44*a*, 44*b* 44*c*, 44*d*. Hereinafter, the second flange 36*b* is sometimes referred to as a support flange 36*b*.

In FIG. 4, the linear guide 42*a* 42*b* have dovetail tail units 55 and dovetail groove units 56. The dovetail tail units 55 have a support column 57*a* secured to the surface 36*c* of the support plate 36*b*, and a dovetail tail 58 serving as a guided member and provided on a side surface of the support column 57*a*. The support column 57*a* and the dovetail tail 58 extend in the direction of the center axis X1 of the bellows 36. The dovetail groove units 56 have a support column 57*b* secured to the first flange 36*a* constituting the casing 25, and a dovetail groove member 59 serving as a guide member and provided on a side surface of the support column 57*b*. The support column 57*b* and the dovetail groove member 59 serving as a guide in the direction of the center axis Z1 of the bellows 36.

The dovetail tails 58 mate with the dovetail grooves of the dovetail groove members 59, The mating of the dovetail tails and the dovetail grooves involves mating in such a way that the parts are slidable in the lengthwise direction (i.e., capable of sliding movement), but are not able to release from the mated state in directions perpendicular to the lengthwise direction. The anode support body 32 which supports the anode 17 moves parallel to the casing 25 as shown by arrow E and arrow J while being guided by the linear guides 42*a*, 42*b*. Through this action of the linear guides 42*a*, 42*b*, the anode support body 32 is guided in such a way as to not experience lateral swaying or tilting. In so doing, the anode 17 can experience parallel movement without laterally swaying within the internal space H of the casing 25.

As shown in FIG. 3, the air cylinders 41*a*, 41*b* shown in FIG. 2 nave a cylinder body 48 and an output rod 49. The cylinder body 48 is secured onto the surface 36*c* of the support plate 36*b*, on the opposite side thereof from the anode 17. The distal end of the output rod is secured to the first flange 36*a*, i.e., to the casing 25, by a bolt 50.

The cylinder body 48 is provided with a first air connection port 51 and a second air connection port 52. These air connection ports are connected to an air supply source, not illustrated. When air is supplied to the first air connection port 51, the output rod 49 experiences extending motion. Due to this extending motion, the support plate 36*b* experiences parallel motion in a direction away from the casing 25 as shown by arrow E. When air is supplied to the second air connector port 52, the output rod 49 experiences contracting motion. Due to this contracting motion, the support place 36*b* experiences parallel motion in a direction towards the casing 25 as shown by arrow J. When the support plate 36*b* experiences parallel motion in the direction of arrow E or the direction of arrow J, the anode 17 which is integrated therewith experiences parallel motion in the same direction. Due to this parallel motion, of the anode 17, any one of the X-ray generation zones 21A, 21B, 27C, 27D, or 27E provided on the anode 17 can be selectively transported to a position facing the cathode 16.

Figure 5:
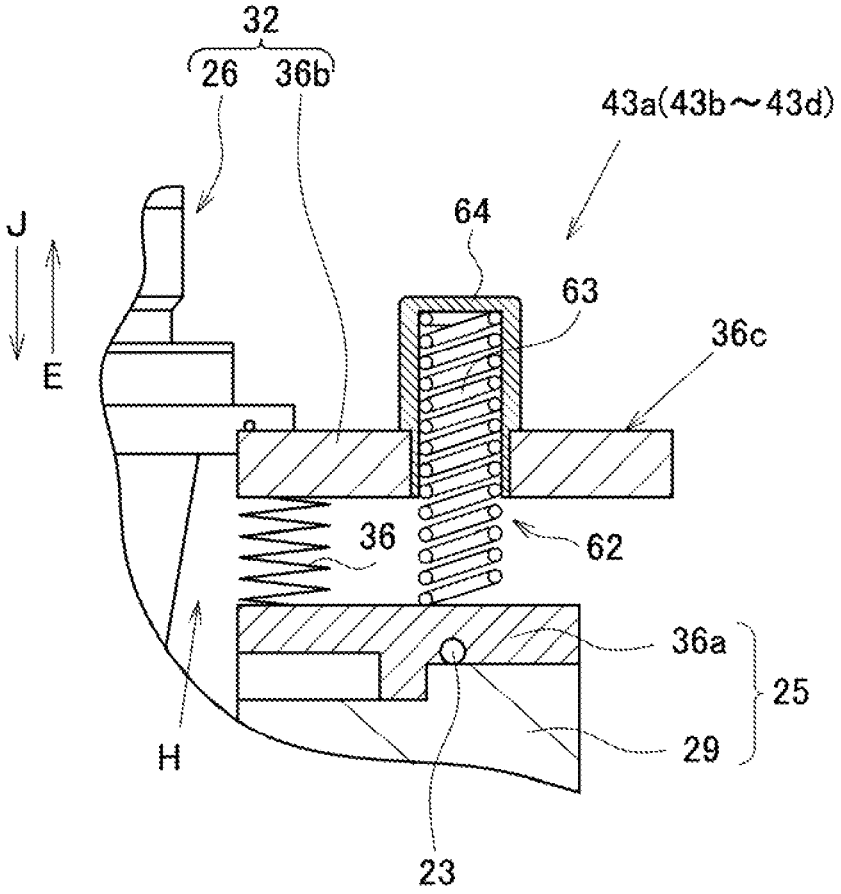
FIG. 5 is a cross sectional view, taken along line C-C in FIG. 2, showing the longitudinal cross sectional structure of an assist unit which is a principal part of the X-ray generator.

FIG. 5 shows a cross sectional, structure of an assist unit 43*a*, taken in the longitudinal direction along line G-G in FIG. 2. The other assist units 43*b*, 43*c*, 43*d* are identical in structure. The assist unit 43*a* has a through-hole 62 that opens through the support plate 36*b* constituting the second flange of the bellows 36, a compression spring 63 that abuts at one end the first flange 36*a* (which constitutes the casing 25) of the bellows 36, and a spring cover 64 fitted at one end into the through-hole 62 of the support plate 36*b*. The compression spring 63 passes through the through-hole 62 of the support plate 36*b*.

An end of the spring cover 64 which is fitted into the through-hole 62 of the support plate 36*b* is open, and the end on the opposite side therefrom is closed. The spring cover 64 compresses the compression spring 63 by means of the closed end. The compression spring 63 imparts to the anode support body 32 spring force (i.e., elastic force) commensurate to the compressed length. In this way, the anode support body 32 is urged in the direction of arrow E (i.e., a direction away from the internal space H) by the compression spring 63.

In FIG. 4, the internal space H of the casing 25 is evacuated and set to a vacuum state by the exhaust device 34. For this reason, the anode support body 32 which comprises the anode housing 26 and the support plate 36*b* tends to be pushed by atmospheric pressure pushing it in the direction of arrow J (i.e., the direction towards the internal space H). The urging force exerted in the direction of arrow E on the anode support body 32 by the compression spring 63 of FIG. 5 acts as force to push back in the opposite direction the anode support body 32 which is being vacuum suctioned, to produce a balance of force.

Figure 6:
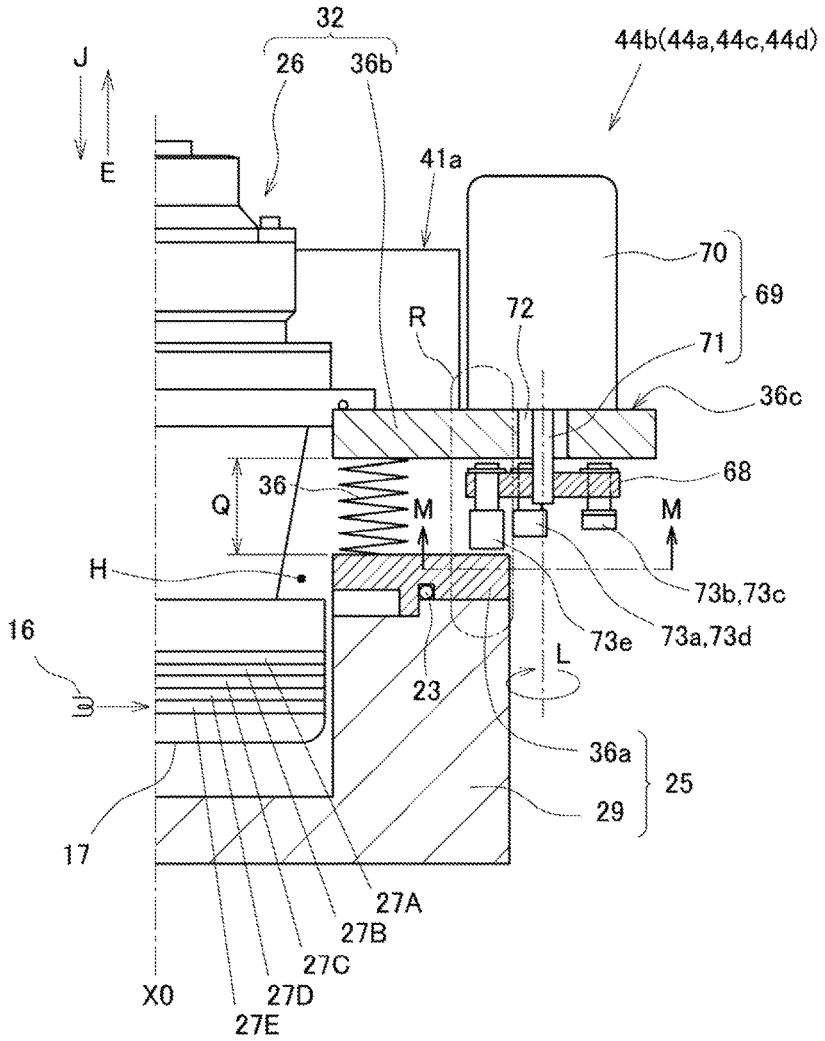
FIG. 6 is a cross sectional, view, taken along line K-K in FIG. 2, showing the longitudinal cross sectional structure of a stopper device which is another principal, part of the X-ray generator.

FIG. 6 shows the longitudinal cross-sectional structure of the stopper device 44*b*, taken along line K-K in FIG. 2. The other stopper devices 44*a*, 44*c*, 44*d* are identical in structure. In FIG. 6, the stopper device 44*b* has a rotating plate 68 as a mobile platform, and an electric motor 69 as mobile platform driving means. The electric motor (hereinafter simply called a "motor") 69 has a motor body 70 and an output shaft 71. The motor body 70 is secured to a surface 36*c* of the support plate 36*b* on the opposite side from the internal space H. The output shaft 71 passes through a through-hole 72 provided to the support plate 36*b* on the opposite side from opposite side of the support plate 36*b*. The rotating plate 68 is secured to the output shaft 71 jutting toward the opposite side of the support plate 36*b*. The motor 69 is a motor in which the rotation angle of the output shaft 71 is controllable, e.g., a servo motor or a pulse motor. The rotating plate 68 is driven by the motor 69 and rotates about the output shaft 71 as indicated by arrow L.

Figure 7:
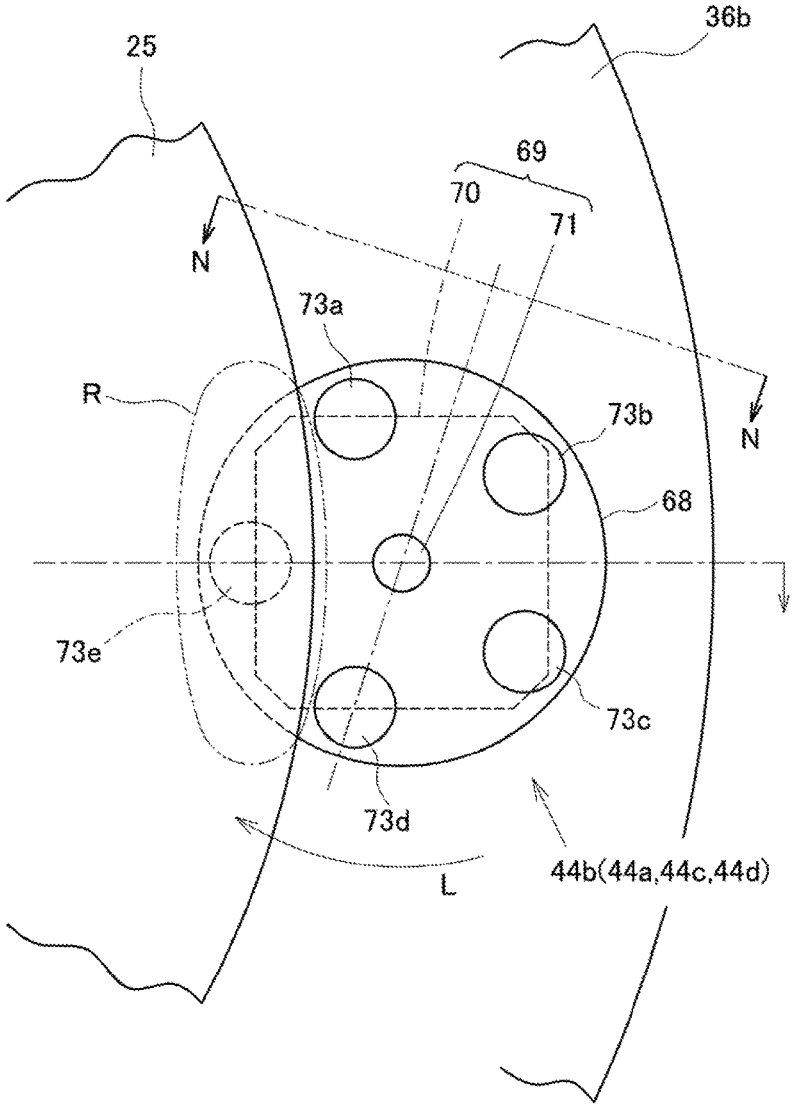
FIG. 7 is a plan view showing the planar structure of the stopper device, taken along line M-M in FIG. 6.

FIG. 7 shows the planar configuration of the stopper device 44*b*, taken along line M-M in FIG. 6. As shown in FIG. 7, the rotating plate 68 attached to the output shaft 71 of the motor 69 is formed to a round shape. When the motor 69 operates and the output shaft 71 rotates, the rotating plate 68 rotates as shown by arrow L. There are also instances of rotation in the opposite direction of arrow L. When the rotating plate 68 rotates in this manner, an annular peripheral section of the rotating plate 68 goes into and out from a region R sandwiched by the casing 25 and the support plate 36*b* which supports the motor 69.

Figure 8:
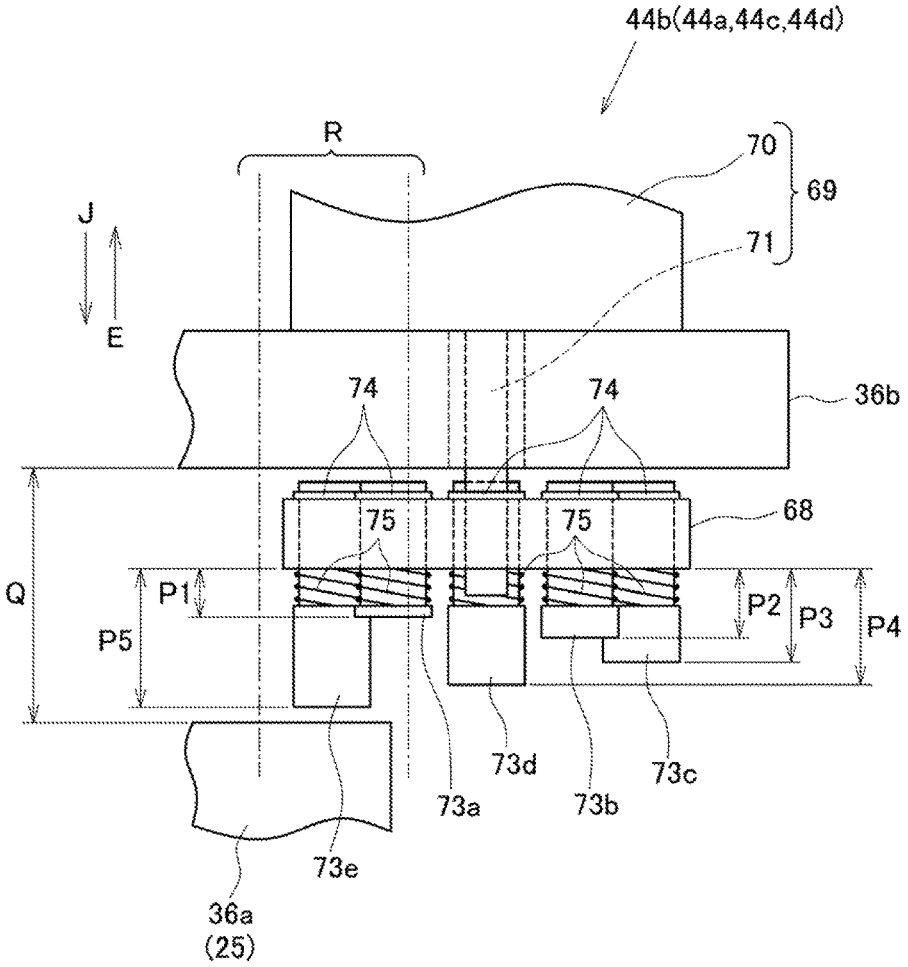
FIG. 8 is a side view of the stopper device taken along line N-N in FIG. 7.

The annular peripheral section of the rotating plate 68 (i.e., the section that enters and exits from between the casing 25 and the support plate 36*b*) is provided with a plurality of stop members 73*a*, 73*b*, 73*c*, 73*d*, 73*e*. In the present embodiment, the stop members number five. FIG. 8 shows the structure of a side surface of the stop member 44*b*, taken along line N-N in FIG. 7. As shown in FIG. 8, each of the five stop members 73*a*, 73*b*, 73*c*, 73*d*, 73*e* in a shaft portion thereof passes through a through hole provided to the rotating plate 68. The shaft members are capable of sliding in the axial direction in the axial direction relative to the rotating plate 68.

Retaining rings 74 are attached at the distal ends (top ends in FIG. 8) of the shaft portions of the stop members 73*a*, 73*b*, 73*c*, 73*d*, 73*e*. Compression springs 75 are provided between the rotating plate 86 and the heads of the stop members 73*a*, 73*b*, 73*c*, 73*d*, 73*e*. Through this configuration, in the natural state, the stop members 73*a*, 73*b*, 73*c*, 73*d*, 73*e* are urged in a direction shown by arrow J (i.e., towards the anode 17 (see FIG. 6)) by the spring force (i.e. elastic force) of the compression springs 75.

The heights P1, P2, P3, P4, P5 of the stop members 73*a*, 73*b*, 73*c*, 73*d*, 73*e*, as measured from the surface on the casing 25 side of the rotating plate 68, differ from one another.

Specifically,

P1<P2<P3<P4<P5.

These differences in height correspond to the positions, in the direction of extension of the axis X0, of the individual X-ray generation zones 27A, 27B, 27C, 27D, 27E of FIG. 6.

The state depicted in FIG. 6 is one in which the output rods 49 of the air cylinders 41*a* and 41*b* from FIG. 3 are extended to maximum length. At this time, the gap Q between the support plats 36*b* and the casing 25 is in a state of maximum opening. As shown in FIG. 8, the gap Q at this time is in a state such that even when the tallest stop member 73*e* has been inserted between the casing 25 and the support plate 36*b*, a gap is present between a distal end of the stop member 73*e* and the surface of the casing 25, while at the same time, a gap is present between the other distal end of the stop member 73*a* and the surface of the support plate 36*b*. With the gap Q between the support plate 36*b* and the casing 25 in a state of maximum opening in this way, when the rotating plate 86 has rotated as shown by arrow L in FIG. 6, any one of the stop members 73*a*, 73*b*, 73*c*, 73*d*, 73*e* will be able to enter the region R sandwiched by the casing 25 and the support plate 36*b*, and to do so without contacting the casing 25, i.e., without touching it.

Because the X-ray generator 2 of the present embodiment is configured in the above manner, in the event that, for example, the X-ray generation zone 27E in FIG. 6 is selected, first, the motor 69 is operated with the gap Q in a state of maximum opening, the output shaft 71 is rotated, and the stop member 73*e* is arranged at the center of the region R. At this time, the other stop members are arranged outside of the region R. In FIG. 3, the output rods 49 of the air cylinders 41*a* and 41*b* undergo contracting motion. The support plate 36*b* thereby undergoes parallel, motion towards the casing 25 as shown by arrow J. At this time, in FIG. 8, the distal end (the distal end at the lower side in FIG. 8) of the head portion of the stop member 73*e* first comes into abutment against the casing 25, and is then further pressed.

Figure 9:
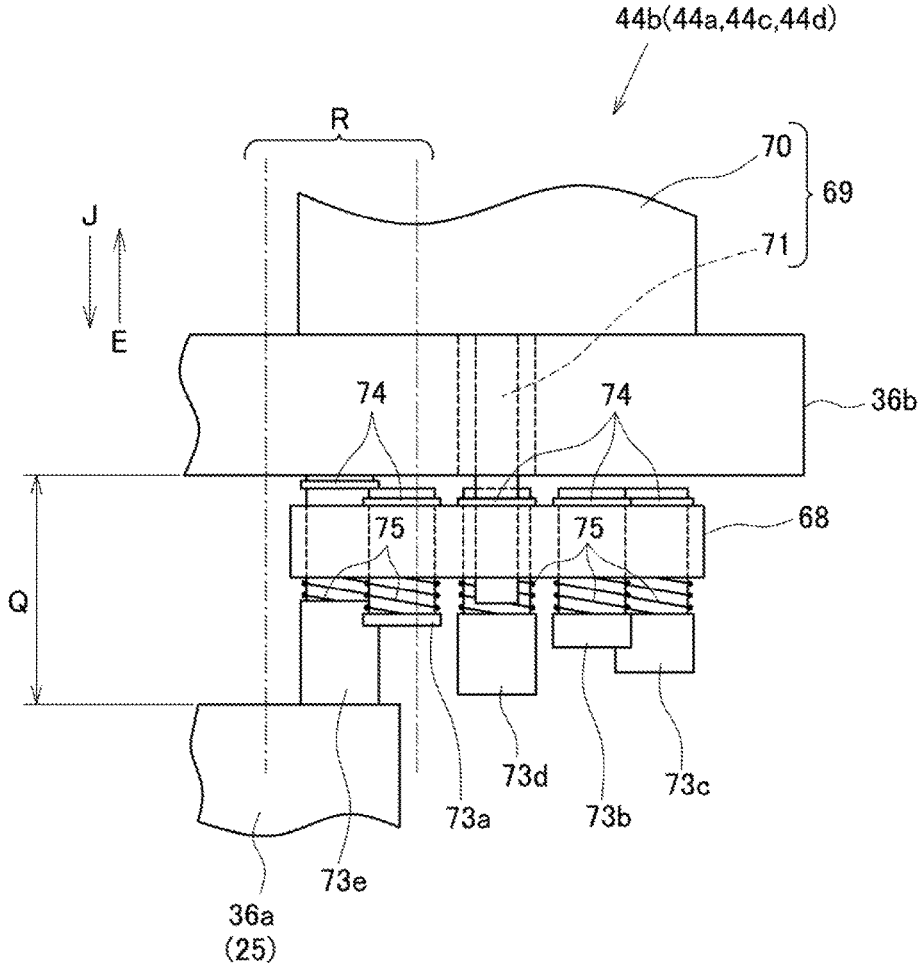
FIG. 9 is a side view showing the stopper device shown in FIG. 8, depicted while performing a stopper function.

Next, the compression spring 75 is compressed, and finally the distal end at the opposite side of the stop member 73*e* (the distal end at the top side in FIG. 9) abuts the surface of the support plate 36*b* as shown in FIG. 9, and parallel motion of the support plate 36*b* in the direction of arrow J halts. In this way, the stop member 73*e* functions as an accurate positioning stopper for halting the motion of the support plate 36*b*.

There is no limitation to selecting the stop member 73*e* which corresponds to the X-ray generation zone 27E, and through appropriate selection of the stop member 73*a*-73*e* corresponding to the desired X-ray generation zone 27A-27E, the desired X-ray generation zone can be arranged correctly and accurately at the prescribed position. Moreover, by designing the stop members 73*a*-73*e* to be slidable with respect to the rotating plate 68, the rotating plate 68 and the output shaft 71 are not subjected to an axial load, a radial load, or a moment load, and positioning of the anode 17 among a multitude of positions can be accomplished with the compressive load of the stop members 73*a*-73*e* only.

Where the one X-ray generation zone 27E is facing the cathode 16 in FIG. 4 in the manner described above, when electrons are emitted from the cathode 16, the electrons collide with the X-ray generation zone 27E, and X-rays of wavelength corresponding to the metal of which the X-ray generation zone 27E is formed are emitted in all directions from, the X-ray generation cone 27E. Some of the X-rays are then extracted to the outside through the X-ray window 28. As stated above, these X-rays R1 are utilized for X-ray analysis measurements in FIG. 1.

When it has become necessary to produce X-rays from an X-ray generation zone other than the X-ray generation gone 27E in order to change the conditions of X-ray analysis measurement, first, the air cylinder 41*a* and the air cylinder 41*b* are simultaneously made to undergo extending motion in FIG. 3, and the anode support body 32 (i.e., the support plate 36*b*) is retracted to a position furthest away from the casing 25. In so doing, the system is set to a state in which the gap Q between the support plate 36*b* and the casing 25 is at maximum opening, as shown in FIG. 6 and FIG. 8. In so doing, a state in which the rotating plate 68 which supports the stop members 73*a*, 73*b*, 73*c*, 73*d*, 73*e* can rotate freely between the support plate 36*b* and the casing 25.

Next, the rotating plate 68 is rotated by the motor 69 in such a way that, from among the stop members 73*a*-73*d* of FIG. 8, a stop member (any one of 73*a*, 73*b*, 73*c*, and 73*d*) of height corresponding to a desired X-ray generation zone, which X-ray generation zone is different from the X-ray generation zone 27E of FIG. 3, is positioned at the center of the region R between the casing 25 and the support plate 36*b*. Subsequently, the air cylinders 41*a*, 41*b* of FIG. 3 are operated, and the output shafts 49 are made to undergo contracting motion until halted by the stop member. By means of this contracting motion, the X-ray generation zone (any one of 27A, 27B, 27C, and 27D) that corresponds to the height of the stop member (any one of 73*a*, 73*b*, 73*c*, and 73*d*) that is present within the region R of FIG. 6 can arranged in a secure state at a position facing the cathode 26.

When thermal electrons are emitted from the cathode 16 in this state, X-rays of wavelength corresponding to the metal of which the facing X-ray generation zone (any one of 27A, 27B, 27C, and 27D) is formed are emitted from that X-ray generation zone, and a portion thereof are extracted to the outside from the X-ray window 28 of FIG. 4.

As shown in FIG. 2, in the present embodiment, all of the elements among the air cylinders 41*a*, 41*b* serving as the driving means, the linear guides 42*a*, 42*b* serving as the guide means, the assist units 43*a*-43*c* serving as the elastic force-imparting means, and the stopper devices 44*a*-44*d* serving as the stopper means are provided together on the support plate 36*b* which is a single member, and specifically on the second flange 36*b* of the bellows 36, whereby the X-ray generator 2 can foe given an overall configuration which is very compact.

In FIG. 2, the surface 36*c* of the support plate 36*b* which is the second flange of the bellows 36 is orthogonal to the center axis X1 of the bellows 36. The two air cylinders 41*a* and 41*b* are provided at different positions within this surface 36*c*. Further, the air cylinders 41*a* and 41*b* are provided at uniformity with respect to the center axis X1 of the bellows 36. Further, the two linear guides 42*a* and 42*b* are also provided at different positions within the surface 36*c*. The linear guides 42*a* and 42*b* are also provided at uniformity with respect to the center axis X1 of the bellows 36.

Further, the four assist units 43*a*-43*d* are also provided at different positions within the surface 36*c*. The assist units 43*a*-43*d* are also provided at uniformity with respect to the center axis X1 of the bellows 36. Further, the four stopper devices 44*a*-44*d* are provided at different positions within this surface 36*c*. The stopper devices 44*a*-44*d* are provided at uniformity with respect to the center axis X1 of the bellows 36.

In the present description, "uniformity" of the plurality of members refers to a state of arrangement of the plurality of members in such, a way that when equal forces are applied to the members in the same direction, the point of application of the resultant force which is a force synthesized from, these forces is generally aligned with the center axis X1 of the bellows 36 serving as the seal member. Here, the term "generally" in the wording "generally aligned" is used in a sense that includes cases in which the point of application of the resultant force diverges from the center axis X1 by an extent such that the anode unit 24 supported by the anode support body 32 as shown in FIG. 3 and FIG. 4 can undergo parallel motion without significant tilt and with no practical difficulty.

Specifically, in FIG. 2, when forces of equal magnitude are applied, in the same direction to the two air cylinders 41*a* and 41*b*, the point of application of the resultant force thereof is generally aligned with the center axis X1 of the bellows 36. More specifically, the air cylinder 41*a* and the air cylinder 41*b* have a point-symmetrical positional relationship in relation to the center axis X1 of the bellows 36. Also, within the surface 36*c* of the second flange 36*b*, the air cylinder 41*a* and the air cylinder 41*b* have a line-symmetrical relationship in relation to a line C-C passing through the center axis X1 of the bellows 36. Moreover, the air cylinder 41*a* and the air cylinder 41*b* are arranged equidistantly from the center axis X1 of the bellows 36, and at equal intervals of 180°.

Additionally, when forces of equal magnitude are applied in the same direction to the two linear guides 42*a* and 42*b*, the point of application of the resultant force thereof is generally aligned with the center axis X1 of the bellows 36. More specifically, the linear guide 42*a* and the linear guide 42*b* have a point-symmetrical positional relationship in relation to the center axis X1 of the bellows 36. Also, within the surface 36*c* of the second flange 36*b*, the linear guide 42*a* and the linear guide 42*b* have a line-symmetrical relationship in relation to a line B-B passing through the center axis X1 of the bellows 36. Moreover, the linear guide 42*a* and the linear guide 42*b* are arranged equidistantly from the center axis X1 of the bellows 36, and at equal intervals of 180°.

The four assist units 43*a*-43*d* are arranged at the four corners of a hypothetical oblong L centered on the center axis X1. Therefore, when forces of equal magnitude are applied in the same direction to the assist units 43*a*-43*d*, the point of application of the resultant force thereof is generally aligned with the center axis X1 of the bellows 36. More specifically, the assist units 43*a*-43*d* hate a point-symmetrical positional relationship in reaction to the center axis X1 of the bellows 36. Also, within the surface 36*c* of the second flange 36*b*, the assist units 43*a*-43*d* have a line-symmetrical relationship in relation to the line B-B and the line C-C, respectively, which pass through the center axis X1 of the bellows 36.

Further, when forces of equal magnitude are applied in the same direction to the four stopper devices 44*a*-44*d*, the point of application of the resultant force thereof is generally aligned with the center axis X1 of the bellows 36. More specifically, the stopper devices 44*a*-44*d* have a point-symmetrical positional relationship in relation to the center axis X1 of the bellows 36. Also, within the surface 36*c* of the second flange 36*b*, the stopper devices 44*a*-44*d* have a line-symmetrical relationship in relation to the line B-B and the line C-C, respectively, which pass through the center axis X1 of the bellows 36. The stopper devices 44*a*-44*d* are arranged equidistantly from the center axis X1 of the bellows 36, and at equal intervals of 180°.

As shown above, in the present embodiment, the plurality of air cylinders 41*a*, 41*b*, the plurality of linear guides 42*a*, 42*b*, the plurality of assist units 43*a*-43*d*, and the plurality of stopper devices 44*a*-44*d* are respectively arranged with uniformity in relation to the center axis X1 of the bellows 36, and therefore when the anode unit 24, driven by the air cylinders 41*a*, 41*b*, undergoes advancing and retracting motion with respect to the casing 25, the anode 17 experiences proper parallel motion with no lateral swaying or tilting. Consequently, the five X-ray generation zones 27A-27E in FIG. 4 can face the cathode 16 at the same distance and the same angle with respect to the cathode 16. That, is, correct, reproducible positional accuracy of the X-ray generation zones 27A-27E with respect to the cathode 16 can be obtained.

In the present embodiment, the stop members 73*a*-73*e* of FIG. 6, driven by the motor 69, change the positions of the X-ray generation zones 27A-27E of the anode 17, and therefore position adjustment of the X-ray generation zones 27A-27E can be accomplished automatically instead of manually. Further, conventionally, the distal end surface of a check bolt was employed as a stopper to adjust the positions of three or more X-ray generation zones, and the amount of threading of the check bolt was varied in order to change the position of the distal end surface of the check bolt. With this method, the positions of the X-ray generation zones could not be finely adjusted with high accuracy automatically.

By contrast, in the present embodiment, any one of the plurality of stop members 73*a*-73*e* of different heights can be selectively interposed between the anode support body 32 and the casing 25, so as to adjust the relative positions of the anode 17 supported by the anode support, body 32 and the cathode 16 supported by the casing 25, whereby the relative positions of the cathode 16 and the X-ray generation zones 27A-27E an the anode 17 can be adjusted with high accuracy.

(Other Embodiments)

While the present invention has been described above in terms of its presently preferred embodiment, the present invention is not limited to this embodiment, and various modifications are possible within the scope of the invention disclosed in the claims.

For example, in the aforedescribed embodiment, the rotating plate 68 was employed as the mobile platform as shown in FIG. 6. However, a platform designed to undergo direct advance motion may be employed to configure the mobile platform. The means for driving the mobile platform is not limited to a motor designed for rotary driving of a target object, and a drive device designed for direct advance driving of a target could be selected.

When working the present invention, it is not always necessary to employ guide means like the linear guides 42*a*, 42*b* shown in FIG. 4, or elastic force-imparting means like the assist units 43*a*, 43*b*, 43*c*, 43*d* shown in FIG. 5.

Figure 10:
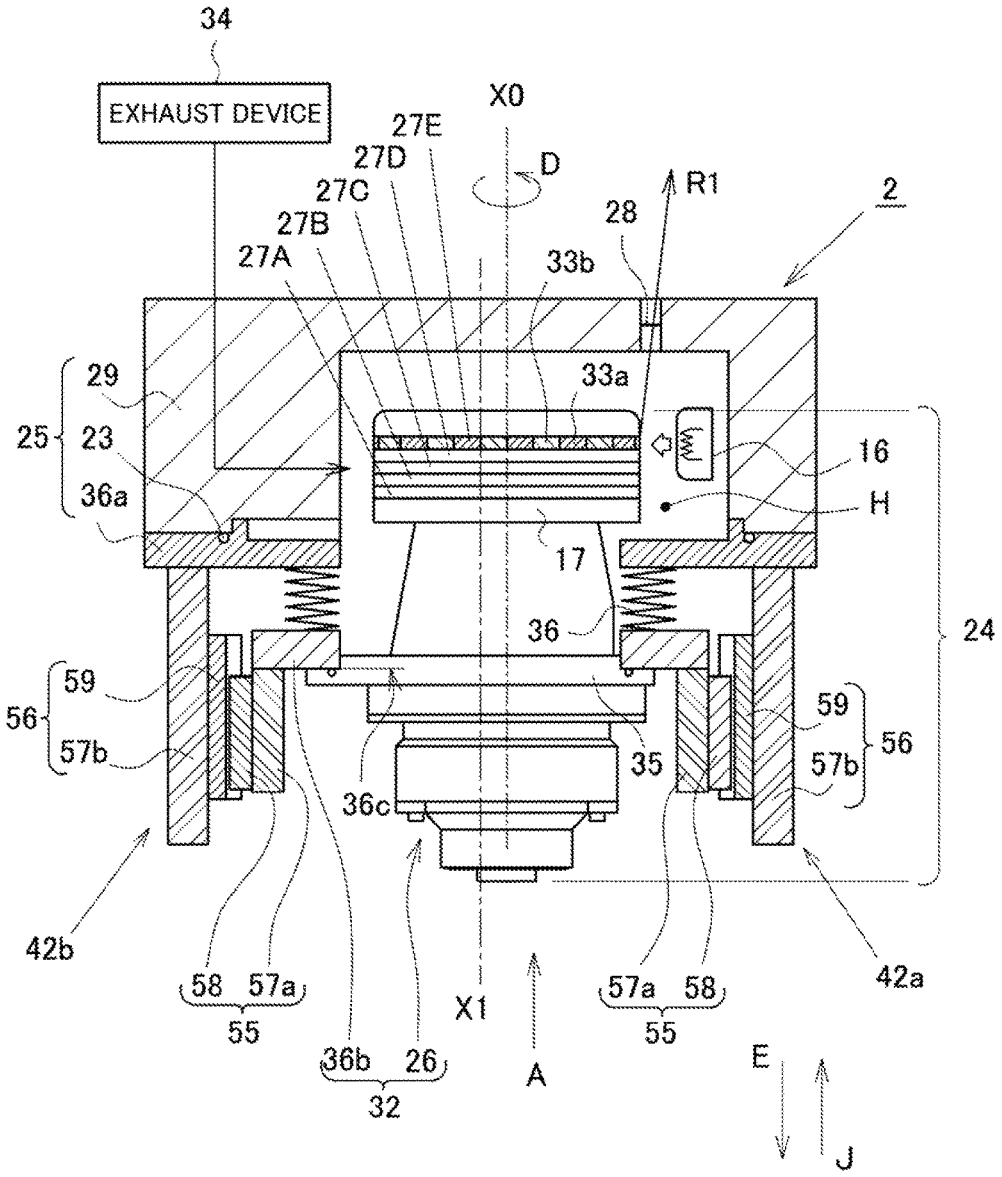
FIG. 10 is a cross sectional view showing another embodiment of the X-ray analyzer according to the present invention.

FIG. 10 shows yet another embodiment. In this embodiment, a single X-ray generation zone 27E is formed from two types of metals, a first metal 33*a* and a second metal 33*b*. These metals 33*a* and 33*b* are arranged alternately in the circumferential direction of the rotating anode 17. The first metal 33*a* is copper (Cu) for example, and the second metal 33*b* is molybdenum (Mo), for example.

The reason for forming a single X-ray generation zone from a plurality of different types of metals is so as to be able to generate X-rays of different wavelengths (i.e. different energies) from a single X-ray generation zone. Such an X-ray generation structure is disclosed by way of a striped target, for example, in Japanese latent Publication No. 5437180.

In the present embodiment, it is acceptable to employ three or more types of metals to form a single X-ray generation zone.

REFERENCE SIGNS LIST

1. X-ray diffractometer (X-ray analyzer), 2. X-ray generator, 3. goniometer, 4. θ-rotation, platform, 5. 2θ-rotation platform, 6. detector arm, 7. divergence slit, 10. specimen holder, 11. scattering slit, 12. receiving slit, 13. two-dimensional X-ray detector ( X-ray detection means), 14. two-dimensional sensor, 16. cathode, 17. rotating anode, 20. θ-rotation driving device, 21.2θ-rotation driving device, 23. o-ring, 24. anode unit, 25. casing, 26. anode housing (anode support body), 27A, 27B, 27C, 27D, 27E. X-ray generation zones, 29. base, 30. rotating shaft, 31. water passage, 32. anode support body, 34. exhaust device, 35. flange, 36. bellows, 36*a*. first flange of bellows, 36*b*. second flange of bellows (support plate), 36C. surface of second flange, 38. magnetic seal device, 40. motor (rotation driving device), 41*a*, 41*b*. air cylinders (driving means), 42*a*, 42*b*. linear guides (guiding means), 43*a*, 44*b*, 44*c*, 44*d*. assist units (elastic force imparting means), 44*a*, 44*b*, 44*c*, 44*d*. stopper devices (stopper means), 46. water supply port, 47. water discharge port, 48. cylinder body, 49. output rod, 50. bolt, 51. first air connection port, 52. second air connection port, 55. dovetail tail units, 56. dovetail groove units, 57*a*, 57*b*. support column, 58. dovetail tail, 59. dovetail groove member, 62. through-hole, 63. compression spring, 64. spring cover, 68. rotating plate (mobile platform), 69. electric motor (mobile platform driving means), 70. motor body, 71. output shaft, 73*a*, 73*b*, 73*c*, 73*d*, 73*e*. stop members, 74. Retaining rings, 75. Compression springs (elastic members), F. X-ray focal point, H. internal space, P1-P5. height of stop member, Q. gap, R. region sandwiched by casing and support plate, Cf. focusing circle, Cg. goniometer circle, R1. X-rays, R2. diffracted X-rays, S. specimen, X0. center axis line of anode housing, X1. center axis line of support plate and bellows.

The invention claimed is:

1. An X-ray generator, comprising:

a cathode for generating electrons;

an anode provided facing the cathode, and equipped with a plurality of X-ray generation zones which are lined up adjacently to one another;

a casing for housing the cathode and the anode in the interior thereof, and integrated with the cathode;

an anode support body for supporting the anode;

driving means for driving the anode support body in such a way that the anode support body and the casing undergo relative advancing and retreating movement; and stopper means for stopping motion of the anode support body when the anode support body and the casing move in a direction of approaching one another;

the stopper means comprising:

a mobile platform equipped with a section that enters and exits from between the anode support body and the casing, a mobile platform drive means for driving the mobile platform, and a plurality of stop members of mutually different heights provided in the entering and exiting section of the mobile platform.

2. The X-ray generator according to claim 1, wherein the mobile platform is provided in such a way as to be able to move in a direction closer towards or away from the casing, in a state in which at least one of the plurality of stop members is placed between the anode support body and the casing.

3. The X-ray generator according to claim 2, wherein the stop member is urged by elastic member.

4. The X-ray generator according to claim 2, wherein the stop members have lengths that are greater than the thickness of the mobile platform, the stop members are provided to pass through the mobile platform, and the stop members are configured such that one end thereof is capable of abutting against either the casing or the anode support body, and the other end of the stop member is capable of abutting against the other of the casing or the anode support body.

5. The X-ray generator according to claim 1, wherein the mobile platform is a rotating plate, the entering and exiting sections are peripheral sections of the rotating plate, and the plurality of stop members are provided at different positions of the peripheral sections of the rotating plate.

6. The X-ray generator according to claim 5, wherein the mobile platform moving means is a motor, the motor has a main body section, and an output shaft that extends to the outside from the interior of the main body section, the rotating plate is attached to the output shaft, and the main body section of the motor is secured to the anode support body or to the casing.

7. The X-ray generator according to claim 1, wherein a plurality of the stopper means are provided on the anode support body or on the casing.

8. The X-ray generator according to claim 7, further comprising a seal member for airtightly partitioning a space between the anode support body and the casing, wherein the plurality of stopper means being arranged point-symmetrically with respect to the center axis of the seal member within a plane orthogonal to the center axis, or line-symmetrically with respect to a line that passes through the center axis.

9. The X-ray generator according to claim 8, wherein the stopper means are arranged at mutually equidistant spacing with respect to the center axis of the seal member, and at mutually equiangular spacing about the center axis.

10. The X-ray generator according to claim 7, wherein the seal member is a bellows, and the stopper means are provided outside the bellows.

11. The X-ray generator according to claim 1, wherein the anode support body comprises;

an anode housing that supports the anode and extends to the outside of the anode, and a support plate that is secured to the anode housing and extends in a direction traversing the direction of extension of the anode housing, the drive means and the stopper means are arranged on the support plate.

12. An X-ray analyzer comprising:

the X-ray generator according to claim 1, and an X-ray optical system employing X-rays generated by the X-ray generator.

* * * * *